United States Patent [19]

Newman

[11] 4,094,326

[45] June 13, 1978

[54] FIRE PROOF CIGARETTE BOX

[76] Inventor: Robert Newman, 1891 Oakland Ave., Wantagh, N.Y. 11793

[21] Appl. No.: 721,206

[22] Filed: Sep. 8, 1976

[51] Int. Cl.[2] ..... A24F 19/10

[52] U.S. Cl. ..... 131/234; 131/238; 131/242

[58] Field of Search ..... 131/234, 231, 237, 238, 131/242, 256, 170 A; 206/247, 266, 86; 116/85

[56] References Cited

U.S. PATENT DOCUMENTS

| | | | |
|---|---|---|---|
| 515,260 | 2/1894 | Smith | 116/85 |
| 1,625,177 | 11/1927 | Bowyer | 131/238 |
| 2,572,863 | 10/1951 | Jaap | 131/242 |
| 3,424,123 | 1/1969 | Giffard | 131/170 X |

*Primary Examiner*—Stephen C. Pellegrino
*Attorney, Agent, or Firm*—Eisenman, Allsopp and Strack

[57] ABSTRACT

An ashtray and cigarette box including an adjustable timer cooperating with a snuffing out cover and an audible alarm which alerts the user if the cover has not been closed after a preselected interval of time.

3 Claims, 3 Drawing Figures

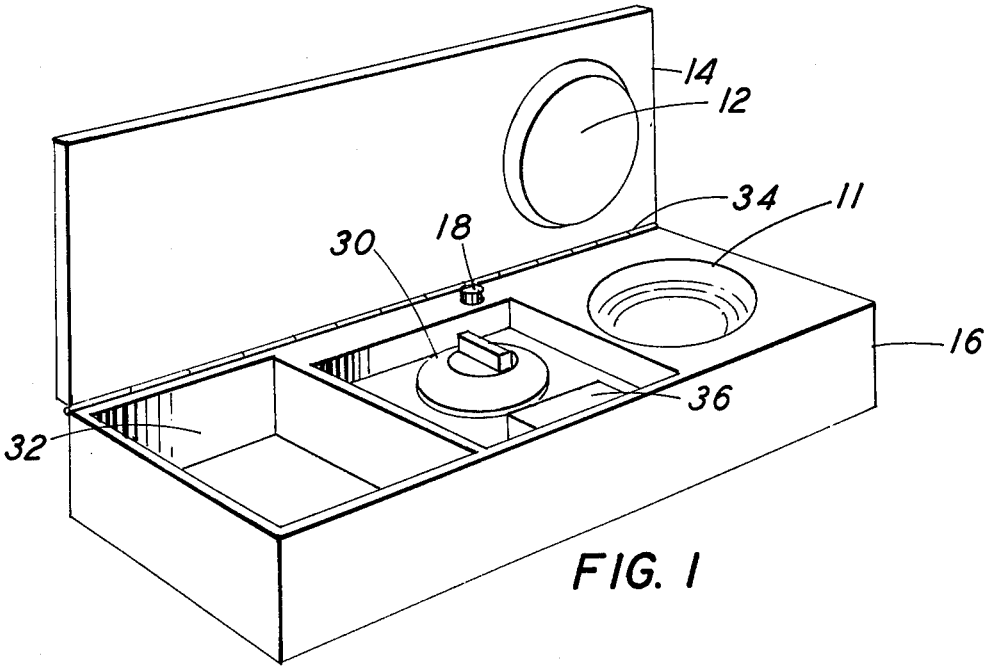
FIG. 1
FIG. 2
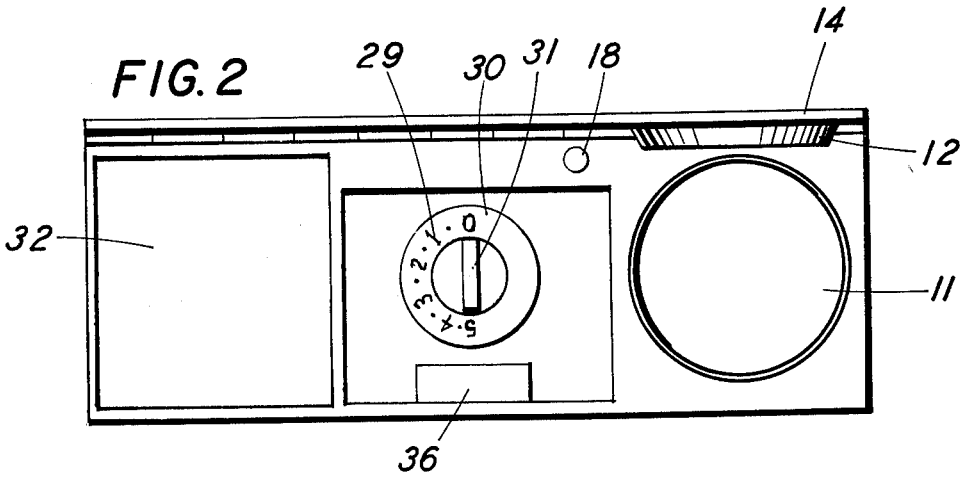
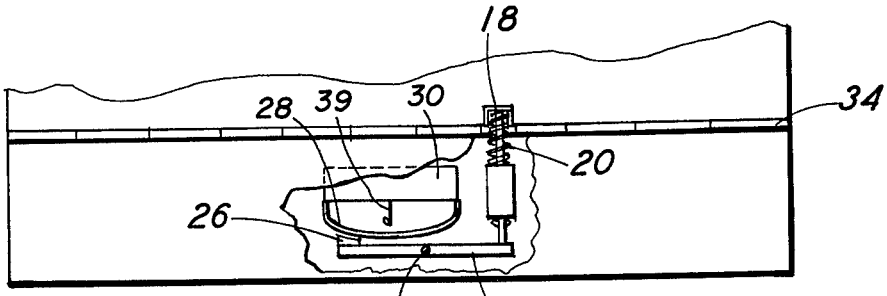
FIG. 3

FIRE PROOF CIGARETTE BOX

BACKGROUND OF THE INVENTION

1. Field of the Invention

This invention relates to ashtrays and, in particular, to safety alarm ashtrays, 2. Description of the Prior Art Although ashtrays are in general use by the millions, most such ashtrays have vertually no safety capabilities. A number of snuffing out type ashtrays have been disclosed including Glessner in U.S. Pat. No. 3,566,882; Breslow in U.S. Pat. No. 3,507,445; Taub in U.S. Pat. No. 3,101,753; McKenzie in U.S. Pat. No. 3,095,108 and Kelly in U.S. Pat. No. 2,588,537.

Several ashtrays with alarms have been disclosed including Dahl's in U.S. Pat. No. 3,205,900.

Most of these references are excessively complex. None serves functions similar to those of this invention.

SUMMARY OF THE INVENTION

It is therefore an object of this invention to overcome the limitations and disadvantages in the ashtray devices in the prior art and currently available in the market.

Oneof the objects of the invention is to provide an ashtray device embodying improved advanced principles of design and construction.

An important object of the invention is to provide an ashtray device which is comprised of a number of simple durable parts and components which can be economically manufactured and readily assembled.

A significant object of the invention is to provide an ashtray device, so designed and constructed that it can be easily employed by almost anybody.

Another object of the invention is to provide safety by alerting the smoker that his cigarette may still be lit.

A further object of the invention is to provide an audible signal to alert the smoker.

Yet another object of the invention is to provide variable timing to control the signal.

A still further object of the invention is to provide means to diminish the signal.

A snuffing out safety ashtray comprising, according to the principles of this invention, a snuffing out cover fitted to a body, an audible alarm and adjustable timing mechanism, and an alarm interrupter cooperating with the cover to diminish the audible signal; a cigarette box for housing the ashtray, alarm, cigarettes and a lighter.

Further objects and advantages of this invention will appear more clearly from the following description of a non-limiting illustrative embodiment and the accompanying drawings in which like numerals designate like parts throughout the several views.

DESCRIPTION OF THE DRAWINGS

Briefly summarized, a preferred embodiment of the invention is described in conjunction with an illustrative disclosure thereof in the accompanying drawings, in which:

FIG. 1 is a pictorial representation of the ashtray housed in a cigarette box according to the principles of this invention;

FIG. 2 is a plan view of the ashtray and cigarette box in an open attitude; and FIG. 3 is a partial and broken out front elevation showing the alarm mechanism.

DESCRIPTION OF THE TYPICAL EMBODIMENT

In the drawings an ashtray 11 having a snuffer 12 embodying features of the invention is illustrated housed in a cigarette box 16 including a hinged 34 cover 14, a cigarette storage compartment 32, an adjustable timer 30, and a lighter 36 which may be built into the box or removable.

The snuffer 12 mounted upon the cover 14 fits into and over the ashtray 11 when the cover 14 is closed, thereby extinguishing any combustible material in the ashtray by shutting off the oxygen supply.

Timer 30 is preferably a known mechanical spring wind-up type, provided with a face imprinted with time period indicating numerals 29 selected by pointing bar 31 towards the desired time period.

The timer 30 is provided with a bell 28 for creating an audible signal in conjunction with a striking hammer. A damper cushion 26 for reducing the audible signal emitted by the belt may be brought into contact with the bell by a mechanism such as pivoted 24 link 22 carrying a vibration dampening cushion 26 and interacting with plunger 18 for contacting cover 14.

The plunger 18 is biased towards the cover 14 by such means as a spring 20. The cover 14 upon closing contacts and depresses plunger 18 which pushes down upon one end of link 22 which raises the other end carrying the damper cushion 26 into contact with bell 28 thereby absorbing some of the vibrations and reducing the magnitude of the audible signal.

The ashtray and cigarette box may be manufactured by known methods of known materials including metal, glass, wood, plastic and so on.

In use, the user opens the cover 14, removes and lights a cigarette and sets the timer 30 to a selected interval. At the end of the selected interval, the alarm sounds to alert the user that the cigarette has not been extinguished. If the cigarette has been extinguished by the closing of the cover 14, the sound of the timer 30 will not be heard.

From the foregoing, the construction and operation of the device will be readily understood and further explanation is believed superfluous.

The invention includes all novelty residing in the description and drawings. It is obvious to those skilled in the art that various minor changes can be made without departing from the concept of this invention and all such as fall within the reasonable scope of the appended claims are included.

What is claimed is:

1. An ashtray comprising: a housing; a removable cover fitted thereto for closing the ashtray and thereby snuffing out lit combustible material in the ashtray; audible alarm means having a wind-up spring type alarm including a timing mechanism, a bell and a hammer for striking the same; and alarm interrupter means within said housing including a spring urged plunger, a pivoted link, and a damper cushion, said spring urged plunger cooperating with said cover on one end thereof, the other end of said plunger contacting one end of said pivoted link, the other end of said pivoted link having said damper cushion secured thereto, the closing of said cover urging said plunger which then pushes said one end of the pivoted link causing said damper cushion to diminish the audible signal of said bell.

2. An ashtray as defined in claim 1, wherein the timing mechanism is adjustable for different time periods.

3. An ashtray as defined in claim 1, wherein said housing further comprises a storage compartment within which items such as cigarettes may be placed.

* * * * *